United States Patent [19]

Anderson et al.

[11] Patent Number: 4,496,060

[45] Date of Patent: Jan. 29, 1985

[54] GARMENT HANGER SUPPORT FOR TRANSPORTABLE WARDROBE

[75] Inventors: William J. Anderson; Wayne R. Anderson, both of Taylorsville, Miss.

[73] Assignee: Enamel Products and Plating Co., McKeesport, Pa.

[21] Appl. No.: 382,533

[22] Filed: May 27, 1982

[51] Int. Cl.[3] ..... A47F 5/00

[52] U.S. Cl. ..... 211/124; 206/279

[58] Field of Search ..... 211/7.8, 123, 192, 124; 206/279, 289

[56] References Cited

U.S. PATENT DOCUMENTS

| | | | |
|---|---|---|---|
| 2,532,021 | 11/1950 | Gunderson | 211/124 X |
| 3,270,865 | 9/1966 | Brennan | 206/279 |
| 3,403,787 | 10/1968 | Browning | 211/124 |
| 3,458,051 | 7/1969 | Zeman et al. | 202/279 X |
| 3,519,139 | 7/1970 | Brennan | 211/124 |
| 4,293,076 | 10/1981 | Collin | 211/124 |

*Primary Examiner*—Robert W. Gibson, Jr.
*Attorney, Agent, or Firm*—Lee, Smith & Zickert

[57] ABSTRACT

A garment hanger support for use with a transportable wardrobe is provided. Detachable hold down clips engage hanger bar brackets to facilitate securing a locking cap to the hanger bar. The clips are easily replaced to permit extended use of the locking cap and hanger bar in the event of damage to a hold down clip. Hook portions of garment hangers are received over a main channel of the hanger bar and secured by the locking cap cooperating with at least one hold down clip. The support ends of the hanger bar are adapted to supportably engage along upper edge portions of opposing vertical sidewalls of a wardrobe. Garments retained on garment hangers may be securely maintained within a wardrobe for safe transportation. The hold down clips are hand-bendable to permit easy locking and unlocking. Also, clip detachment and replacement may be accomplished without the aid of tools.

7 Claims, 6 Drawing Figures

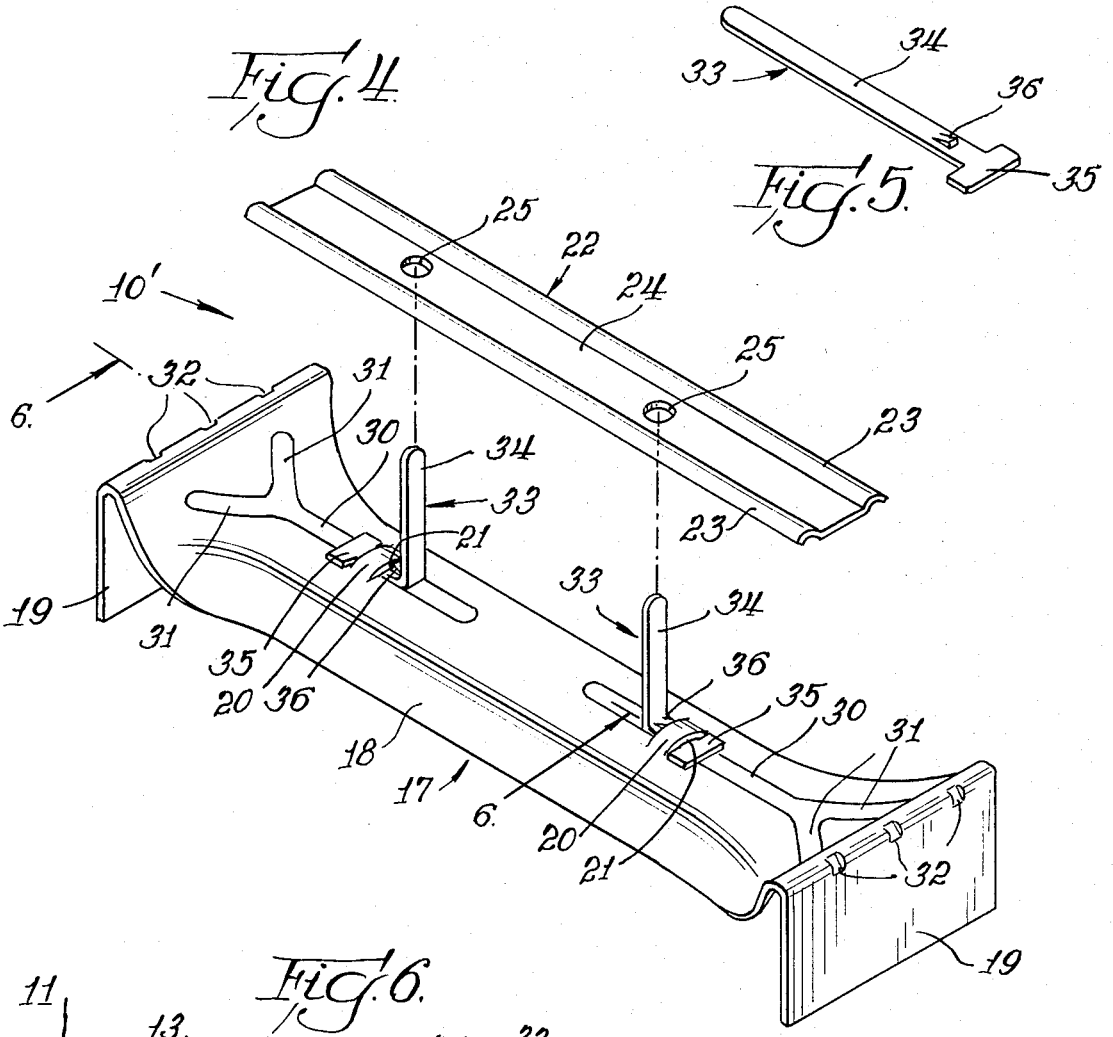
Fig. 4
Fig. 5
10'
6
32
31
30
34
33
21
19
35
20
36
18
17
22
24
25
23
36
35
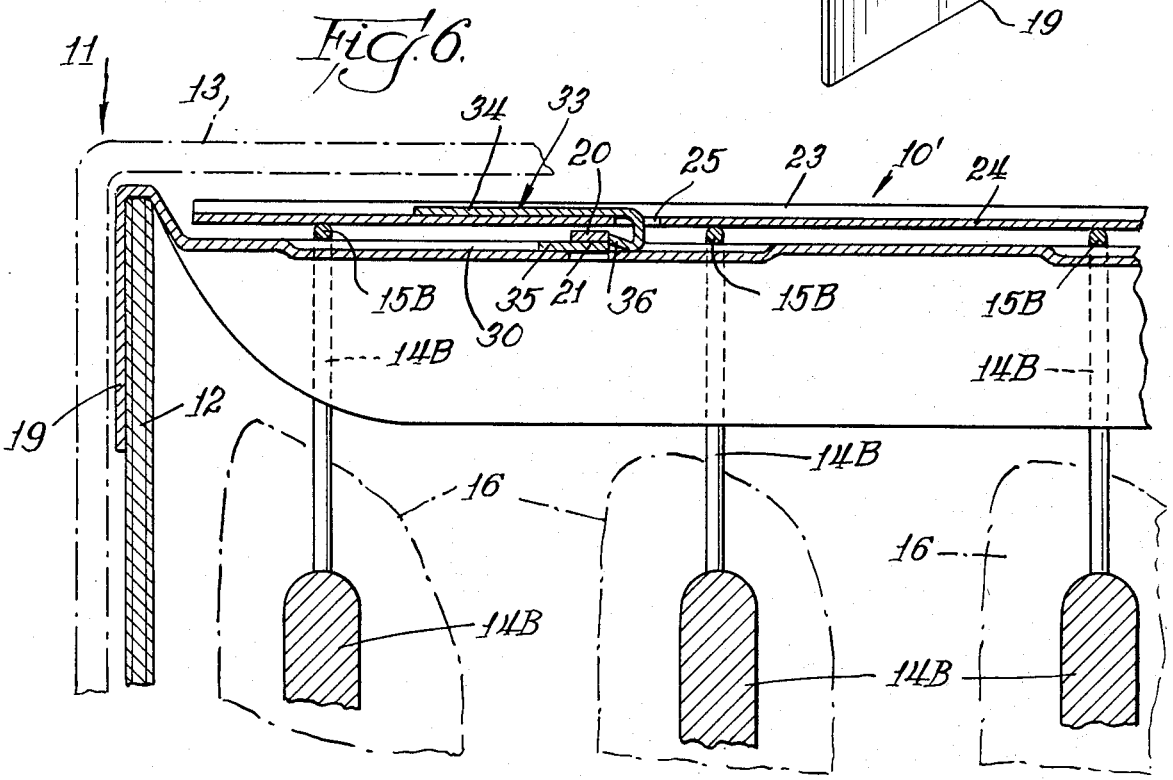
Fig. 6
11
13
34
33
20
25
23
10'
24
15B
35
21
36
30
14B
19
12
16

GARMENT HANGER SUPPORT FOR TRANSPORTABLE WARDROBE

BACKGROUND AND SUMMARY OF THE INVENTION

Support devices for securely retaining garments and hangers in transportable wardrobes have typically included a metal bar with opposite ends supported by the upper vertical edges of wardrobe sidewalls. Such supports are exemplified in U.S. Pat. Nos. 3,197,033, 3,270,865, 3,306,465, 3,519,139 and 3,773,184, all to Brennan. A variety of means have been employed for securement of hangers to the hanger bar. For example, in U.S. Pat. No. 2,805,780 to Brennan, louvred slots along the bar are engaged by hanger hooks. In U.S. Pat. No. 3,270,865, a locking clip for each hanger is shown. U.S. Pat. No. 3,902,597 to Brennan, provides pairs of struck-up nibs along the hanger bar for retention of hanger hooks between the nibs. A widely used form of securement involves a locking cap secured along the top of the hanger bar for substantially the full length of the bar. This type of support device is shown in U.S. Pat. Nos. 3,306,465, 3,519,139, and 3,613,898, all to Brennan. Such devices offer bendable tabs, prongs and tongues extending from either the cap or the bar for bent-over securement after passage through openings in the other member. The hanger hooks are thereby clenched between the cap and bar.

U.S. Pat. No. 3,613,898 includes another aspect of the prior art with the provision of a reversible locking cap for the retention of round-hooks in a first position or square-hooks when inverted to a second position. The bendable securement tongues are shown struck-out from the carrier bar or alternatively from the cap.

In using the bendable extensions for hanger retention, repeated bending causes metal fatigue and damage to these elements. When the damage occurs, re-use of the bar or cap is prevented since the tongues, tabs or prongs, have conventionally been formed as integral struck-out portions of these components and this damage renders the entire component unusable.

It would be a significant advantage for the commercial mover, clothing industry, and others commonly transporting garments, to have available a reliable hanger support device which is durable and can be re-used after bendable portions are damaged by simply replacing a detachable hold down portion. The present invention satisfies these needs.

In satisfying the goals of the invention, a unique hanger support is disclosed which comprises a hold down clip capable of securing a locking cap to a hanger bar by means of engaging a struck-up bracket on the hanger bar and extending through a hole in the locking cap. The clip is bent to overlie the locking cap and complete securement. Hook portions of garment hangers are retained for transport between the locking cap and hanger bar.

For stationing the hanger support in a transportable wardrobe, the hanger bar includes opposite support ends adapted to engage upper edges of opposing vertical sidewalls of the wardrobe. The opposite support ends are integrally formed with a downwardly opening main channel extending therebetween. Struck-up brackets are provided along the main channel and project upwardly to each form a receiving slot for a hold down clip. In order to achieve locking cap securement, struck-up brackets and locking cap holes are located in positional correspondence. A hold down clip engaging a struck-up bracket is accordingly in position to engage the corresponding locking cap hole.

The hold down clip comprises a long arm terminating in a bracket engageable end which is adapted for detachable securement to the struck-up bracket. The long arm of the clip is hand-bendable and requires no special tools to attain securement. The bracket engageable end is hand-disengageable from the struck-up bracket and may include a resilient means for snug but releasable bracket engagement. The long arm is passed through the bracket slot until the engageable end engages the struck-up bracket. The long arm is then bent at generally 90° to the main channel for passage through a corresponding locking cap hole. Securement is then obtained by a continued bending of the long arm to overlie the locking cap. Reversal of the bending and bracket engagement steps detaches the hold down clip. If the hold down clip is not damaged from use, it can remain in bracket engagement leaving the hanger support immediately ready for a next use.

In order to support heavy garments, and the like, the main channel of the hanger bar may include longitudinal reinforcing ribs projecting inwardly and forming elongate recesses along the top of the channel. The ribs offer added strength by terminating in a diverging Y-shape adjacent the support ends of the hanger bar. The struck-up brackets are formed transverse to a portion of the rib. The elongate recess of a rib serves the additional purpose of accommodating a portion of the engageable end of hold down clip within the recess to minimize the distance a bracket has to be struck-up above the upper surfaces of the main channel. The locking cap can then be secured very closely to the channel which results in a snug securement of garment hangers by the locking cap.

BRIEF DESCRIPTION OF THE DRAWING

FIG. 4 is a perspective view of the garment hanger support substantially identical to that of FIG. 1, but having a hold down clip in an alternate embodiment of the invention.

FIG. 5 is a perspective view of the hold down clip as utilized in FIG. 4 prior to bending.

FIG. 6 is a vertical sectional view of the garment hanger support taken along line 6—6 of FIG. 4 and additionally showing garments and hangers retained within a transportable wardrobe.

DESCRIPTION OF EXAMPLE EMBODYING BEST MODE OF THE INVENTION

Figure 1:
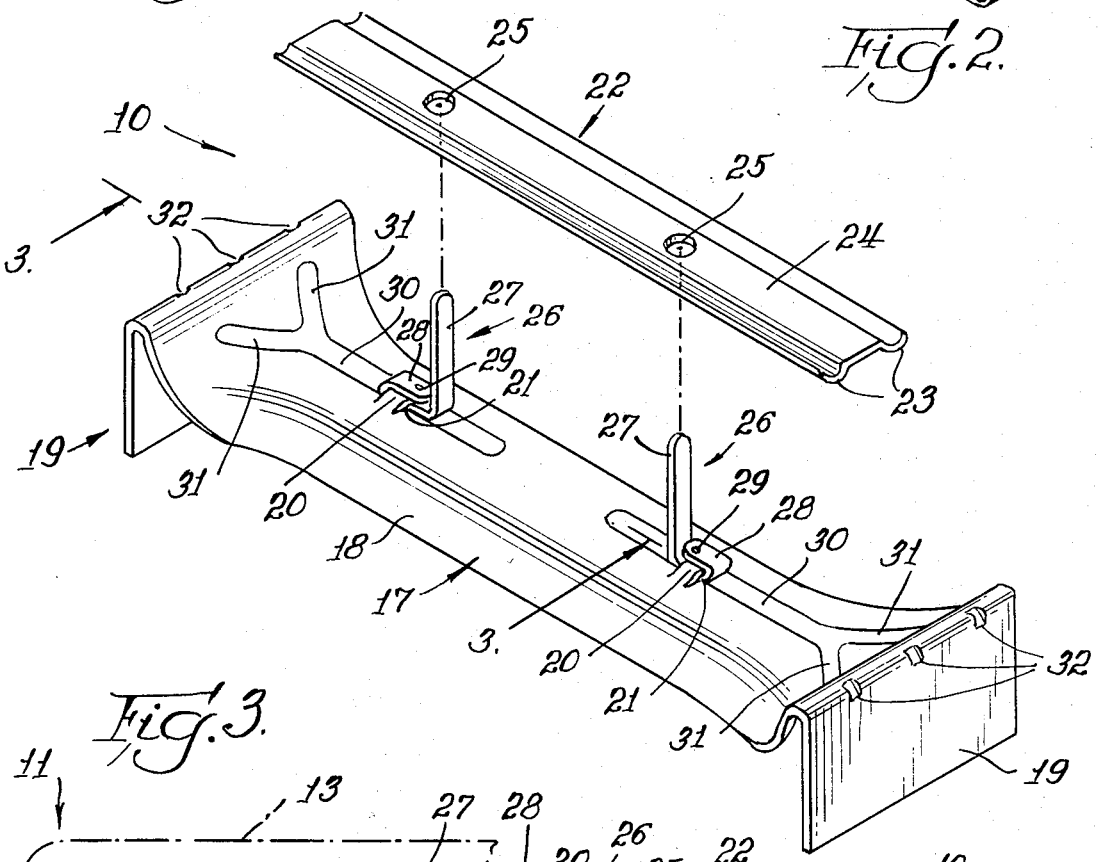
FIG. 1 is a perspective view of the garment hanger support embodying the best mode of the invention and shown with the locking cap ready for locking disposition over the hanger bar.
Figure 2:
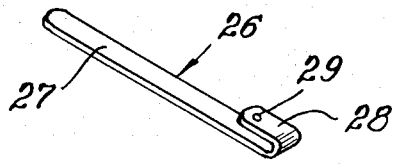
FIG. 2 is a perspective view of the hold down clip as shown in FIG. 1, prior to bending.
Figure 3:
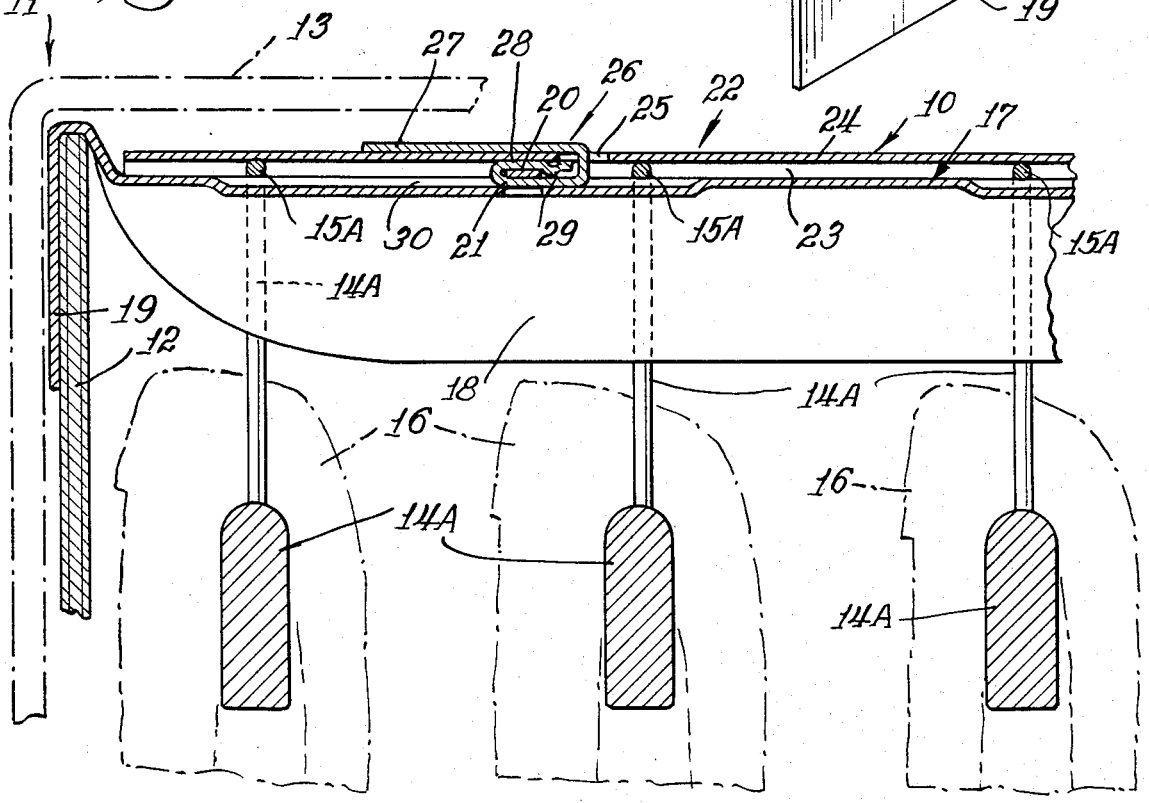
FIG. 3 is a vertical sectional view of the garment support hanger taken along line 3—3 of FIG. 1 and additionally showing the garment hanger support retaining garments and hangers within a transportable wardrobe.

FIGS. 1-3 illustrate garment hanger support 10 for use with transportable wardrobe carton 11. Wardrobe 11 has opposing vertical sidewalls 12 in a conventional corrugated cardboard carton designed for garment transportation. Container cover 13 is provided to overlie wardrobe 11 at upper portions of sidewalls 12. Garment hanger support 10 secures hangers 14A having round-hook portions 15A. Garments 16 are supported within wardrobe 11 on hangers 14A.

Hanger bar 17 provides a supporting surface for hangers 14A atop downwardly opening main channel 18. Bar 17 is supported at support ends 19 by sidewalls 12. Support ends 19 are integral with main channel and fold downwardly to overlap upper side surfaces of sidewalls 12 in a conventional manner. Cover 13 may then be readily disposed atop wardrobe 11. Along main channel 18 struck-up brackets 20 form horizontal slots 21. To secure hangers 14A to main channel 18, a locking cap 22 is provided and has parallel longitudinal ribs 23 with a central web 24 therebetween. Locking cap 22 is of a length substantially the same as main channel 18 to permit hanger placement randomly between support ends 19. Holes 25 through central web 24 are formed to be in positional correspondence with brackets 20.

Upon placement of hangers 14A over channel 18, securement is obtained by detachable hold down clips 26. Clips 26 comprise a long arm 27 which terminates at one end in a bracket engageable means. In the embodiment shown, and as best seen in FIG. 2, the bracket engageable means comprises a short arm 28 rebent over long arm 27 and spaced apart therefrom a sufficient distance to snugly receive bracket 20 therebetween. Short arm 28 further has a great enough length to fully overlap bracket 20. A dimple or projection 29 is provided for resilient engagement with bracket 20. Projection 29 is spaced along short arm 28 at a distance which allows resilient engagement over bracket 20 upon passage of long arm 27 through slot 21. Following insertion of long arm 27 through slot 21, it is bent at right angles to channel 18 in order to be oriented for receipt through a hole 25 of locking cap 22.

Following passage through holes 25, the bending of long arm 27 is continued to fold it back over central web 24 in order to complete the securement of locking cap 22 to hanger bar 17. Hangers 14A are thereby gripped between locking cap 22 and channel 18. Clip 26 is formed of ductile metal so that the bending securement may be easily accomplished by hand without requiring special tools.

For accommodation of heavy garments, hanger bar 17 is strengthened by means of two separated reinforcing ribs 30 extending longitudinally of channel 18 and spaced-apart by an intermediate non-ribbed central portion of channel 18. For additional strength the reinforcing ribs 30 terminate adjacent support ends 19 in a Y-shaped divergence 31. Indents 32 at support ends 19 are provided for additional rigidification. Ribs 30 may alternately be provided for the full length of channel 18 and thereby extend through the non-ribbed central portion of the channel to achieve even greater reinforcement.

Preferentially, two brackets 20 are struck-up from channel 18 each along one of the separated longitudinal ribs 30. The recesses of the ribs form a part of slots 21 in which a portion of the engageable ends of clips 26 reside. Thereby, an additional advantage is obtained by minimizing the height brackets 20 need to be struck-up above channel 18 to form the slots 21. As a result, a close securement between locking cap 22 and support bar 17 is achieved for tightly gripping hooks 15A of hangers 14A. This close tolerance fit is best illustrated in the cross-sectional view of FIG. 3.

After transportation to the unloading destination, cover 13 is removed and clips 26 bent upwardly to permit removal of locking cap 22 and garment hangers 14A. As a result of repeated bending, clips 26 can become fatigued due to metal strain. They might otherwise become damaged through abuse. The invention eliminates the need to discard the entire hanger support 10 and instead advantageously permits the simple replacement of a hold down clip 26 with a new one. Use of the other components may continue. This primary characterizing feature of the invention offers the industry an economic benefit by permitting many loads of garments to be transported with the same components.

With reference to FIGS. 4–6, it will be seen that garment hanger support 10' includes the identical members as shown for support 10, with the exception of hold down clip 33 provided in an alternate embodiment of the invention. Additionally, locking cap 22 is shown inverted for utilization with hangers 14B having square-hook ends 15B. In a known manner, locking cap 22 is reversible for utilization with square-hook or round-hook hangers in both hanger supports and 10 and 10'.

Hold down clip 33 includes a bracket engageable widened portion at one end of long arm 34. This widened portion comprises T-shaped end 35 having arms of the T extending generally transverse to long arm 34. Upon passage of long arm 34 through slot 21, the T-shaped end 35 abuts bracket 20 to stop, or limit, passage of long arm 35. A raised barb 36 extends upwardly from long arm 35 at a distance from T-shaped end 35 sufficient to permit resilient engagement with bracket 20. As with hold down clip 26, clip 33 comprises a long arm 34 which is hand bendable to be oriented upwardly for passage through a locking cap hole 25. Upon loading channel 18 with hangers 14B, locking cap 25 is moved downward with holes 25 receiving long arms 34. Long arms 34 are then bent to fold back onto central web 24 for hanger securement.

It will be understood that hold down clips 26 and 33 are interchangeable for utilization in hanger support 10 or 10'. In like manner the recess of ribbing 30 accommodates a portion of clip 33 to minimize the height bracket 20 must be struck-up to provide slot 21.

Garment hanger supports 10 and 10' are suitably formed having hanger bars 17 and locking caps 22 made of sheet metal. Hold down clips 26 and 33 are preferably made of ductile metal to afford hand bending.

Garment hanger supports 10 and 10' in the illustrative embodiment include two struck-up brackets each positionally corresponding with a locking cap hole for engagement with two hold down clips. The invention is not intended to be limited to a two-clip engagement. A single bracket 10 and hole 25 may be provided for a single hold down clip, such as for use in smaller wardrobe cartons. More than two may be utilized for longer hanger bars, when additional securement is needed in an oversize wardrobe carton transporting a large number of hangers and garments.

ACHIEVEMENTS OF THE INVENTION

In accordance with the invention, a re-usable garment hanger support is provided and features a detachable and replaceable hold down clip which eliminates the need to discard the locking cap and hanger bar upon the occurrence of damage only to the hold down clip. A close tolerance fit between the locking cap and hanger bar is afforded for tight retention of hangers therebetween. The invention further affords locking and unlocking by hand without requiring tools. Similarly, clip detachment and removal, when replacement is necessary, is readily accomplished by hand.

What is claimed is:

1. In a garment hanger support for use with a transportable wardrobe of the type including a hanger bar having a downwardly opening main channel extending between support ends, a locking cap extending for substantially the full length of the main channel and adapted for overlying the main channel to secure hanger hooks therebetween, the improvement comprising at least one struck-up bracket integrally formed with the hanger bar along the main channel thereof and forming a slot, at least one hole extending through the locking cap in positional correspondence with said struck-up bracket, a hold down clip having a long arm and bracket engageable means at one end thereof, said bracket engageable means comprising a short arm rebent over the long arm and spaced apart therefrom to receive the bracket therebetween, said long arm being capable of passing through said bracket slot and said short arm having a length sufficient to overlap said struck-up bracket upon passage of said long arm through said bracket slot whereby to facilitate engagement with said bracket at said bracket engageable means, said long arm being bendable to extend upward for passage through said locking cap hole to be rebent over said locking cap to secure said locking cap to the hanger bar, said clip being a part separate and fully removable from said hanger bar and said locking cap, and said bracket engageable means being detachably engageable to said bracket.

2. The improvement as in claim 1 wherein the main channel of said hanger bar includes a longitudinal reinforcing rib forming a recess in said main channel and said struck-up bracket being formed therealong generally transverse to said hanger bar.

3. The improvement as in claim 1 wherein said short arm includes a projection extending in a direction toward said long arm and located therealong a sufficient distance to resiliently engage said struck-up bracket.

4. In a garment hanger support for use with a transportable wardrobe of the type including a hanger bar having a downwardly opening main channel extending between support ends, a locking cap extending for substantially the full length of the main channel and adapted for overlying the main channel to secure hanger hooks therebetween, the improvement comprising at least one struck-up bracket integrally formed with the hanger bar along the main channel thereof and forming a slot, at least one hole extending through the locking cap in positional correspondence with said struck-up bracket, a hold down clip having a long arm and bracket engageable means at one end thereof, said bracket engageable means comprising a widened portion having a width greater than said bracket slot, said long arm being capable of passing through said bracket slot whereby to facilitate engagement with said bracket at said bracket engageable means, said long arm being bendable to extend upward for passage through said locking cap hole to be rebent over said locking cap to secure said locking cap to the hanger bar, said clip being a part separate and fully removable from said hanger bar and said locking cap, and said bracket engageable means being detachably engageable to said bracket.

5. The improvement as in claim 4 wherein said long arm includes a projection located therealong a sufficient distance from said widened portion to resiliently engage said struck-up bracket upon passage of said long arm through the bracket slot.

6. The improvement as in claim 5 wherein said widened portion comprises oppositely extending ears transverse to said long arm forming a generally T-shape.

7. The improvement as in claim 4 wherein the main channel of said hanger bar includes a longitudinal reinforcing rib forming a recess in said main channel and said struck-up bracket being formed therealong generally transverse to said hanger bar.

* * * * *